United States Patent [19]

Hwang

[11] Patent Number: 4,719,777

[45] Date of Patent: Jan. 19, 1988

[54] COMBINATION LOCK FOR BRIEFCASES

[76] Inventor: Blake Hwang, No. 40, Chao An Street, Taipei, Taiwan

[21] Appl. No.: 32,175

[22] Filed: Mar. 30, 1987

[51] Int. Cl.[4] ..... E05B 37/02

[52] U.S. Cl. ..... 70/312; 70/288; 70/306; 70/316

[58] Field of Search ..... 70/312, 306, 323, 326, 70/304, 315–318, 287–288

[56] References Cited

U.S. PATENT DOCUMENTS 2,007,663 7/1935 Rapp ..... 70/306

4,155,234 5/1979 Bako ..... 70/312

*Primary Examiner*—Robert L. Wolfe

*Attorney, Agent, or Firm*—Angelo Notaro

[57] ABSTRACT

A combination lock for a briefcase, comprises a case body, a push button, a plurality of combination dials, a plurality of driven wheels, a sliding sheet, a positioning sheet, a sliding block, a structural body, a back cover, and a plurality of springs, wherein the combination is changeable, and the combination dials are arranged non-axially so that the lock is simple in structure, easy to operate, and small in size. This lock is especially suitable for a briefcase.

1 Claim, 12 Drawing Figures

COMBINATION LOCK FOR BRIEFCASES

BACKGROUND OF THE INVENTION

The locks used in general briefcases or luggage cases can be classified into combination locks and noncombination locks i.e. locks which must be opened by the right key. The keys for a specific type of lock are all the same. Therefore, it can often be seen that the key for the lock of a specific briefcase can be used to open that of another briefcase. Consequently, many persons pay no attention to the preservation of the keys. The noncombination locks thus provide more ornamentation than inaccessibility. However, sometimes it is still necessary to lock a case for safety purposes. This often incurs trouble to find the key. Many cases, therefore, are provided with a combination lock to save the trouble in the preservation of the keys.

General combination locks for cases are combination-changeable. This means that after buying a case, the user may select a preferred combination for opening the lock thereof. This provides much convenience and utility and is the reason why the cases with a combination lock are widely used. Nevertheless, the combination locks with horizontal dials for cases have two main disadvantages: (A) their thickness is much larger than (e.g, about twice) that of a noncombination lock (the combination locks with vertical dials are even larger in thickness and therefore are preferably used in luggage cases) and thus are not suitable to be used in briefcases, and (B) their combination cannot be changed easily (i.e. in combination changing operations of the locks for current cases, a large force must be exerted to rotate the combination dials; this causes inconvenience and is unacceptable for ladies having weak muscles and slender fingers).

A combination lock is combination-changeable by having its dial engaged with or disengaged from the corresponding driven wheel. In normal use, the dial is engaged with the wheel; when the combination is to be changed, the dial and wheel are disengaged from each other so that the relative position thereof can be changed to achieve the effect of changing the combination. The combination dials of the locks are all arranged coaxially, i.e, the combination dials and the corresponding driven wheels are rotated on the same axial. To change the relative position (for combination changing purposes) between a dial and the corresponding driven wheel, they must be completely disengaged from each other. There must be sufficient space in the lock for accommodating the thickness of every combination dial and the corresponding driven wheel and for them to be disengaged from each other. Therefore, the thickness of this type of locks must be much larger than that for a noncombination lock. Moreover, since each combination dial and the corresponding driven wheel are retained to engage with each other by a spring force, a large force must be exerted to rotate the combination dial for changing the relative position between the dial and wheel when the combination is to be changed.

SUMMARY OF THE INVENTION

The main object of the invention is to provide a novel combination lock in which the combination dials and the driven wheels are arranged nonaxially to effectively reduce the thickness of the lock to the most extent.

Another object of the invention is to provide a novel combination lock whose combination can be changed as desired when the pushing button thereof is pushed in the direction opposite to that for opening the lock.

BRIEF DESCRIPTION OF THE DRAWINGS

Other objects and advantages of the present invention will become apparent from the following description with reference to the accompanying drawings wherein.

DESCRIPTION OF THE PREFERRED EMBODIMENT

Figure 2:
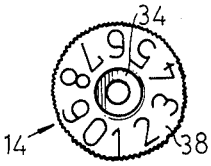
FIG. 2 is a front outside view of a combination dial of the lock in accordance with the invention.
Figure 6:
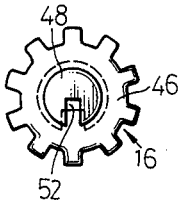
FIG. 6 is a view illustrating a driven wheel of the lock, wherein hub disc (48) and recess (52) are shown by a solid line, and wheel disc (46) and a recess (54) are shown by a dashed line.
Figure 3:
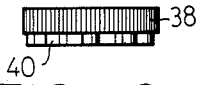
FIG. 3 is a side outside view of the dial as shown in FIG. 2.
Figure 7:
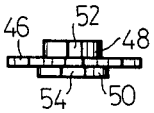
FIG. 7 is side a view of the driven wheel.
Figure 4:
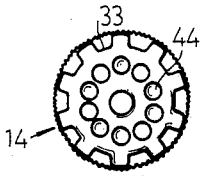
FIG. 4 is a back outside view of the dial.
Figure 8:
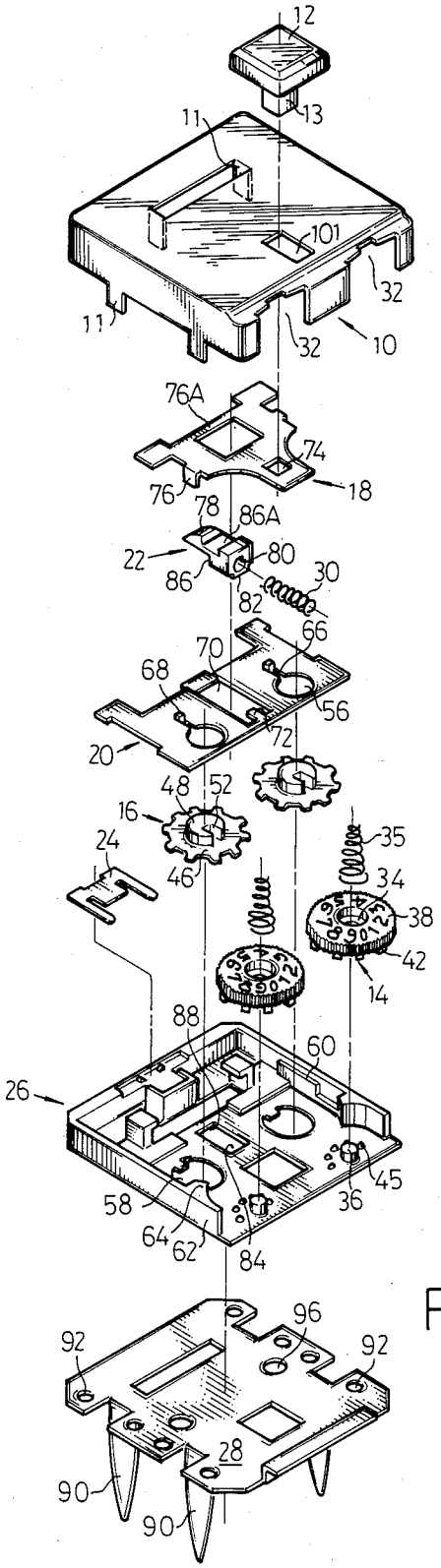
FIG. 8 is an exploded pictorial drawing of the combination lock in accordance with the invention.
Figure 9:
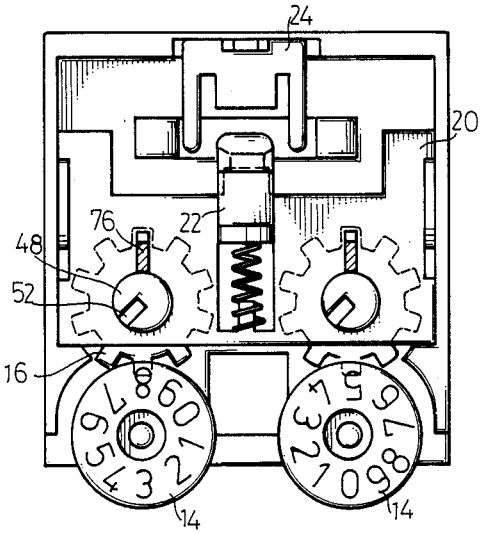
FIG. 9 is a schematic drawing illustrating the combination lock in its off-combination and locked state.

Referring to the drawings, the combination lock in accordance with the invention comprises a case body (10), push button (12), combination dials (14), driven wheels (16) sliding sheet (18), positioning sheet (20), sliding block (22), sheet spring (24), structural body (26), back cover (28), and spring (30), wherein the case body is internally recessed so that all of the lock members except push botton (12), which is provided for being pushed by a finger of the user, can be mounted therein. Combination dials (14) protrude from the corresponding openings (32). Each combination dial is in the form of a wheel which can be dialed by a finger. An aperture (34) is formed in the center of each dial so that it can be mounted on an axle (36) of the structural body (26) and is thus freely rotatable thereon. A spring (35), which has a diameter slightly larger than that of aperture (34), is provided above aperture (34) of each dial (14) and is mounted on corresponding axle (36) so that when case (10) is closed on structural body (26), the spring (35) can continuously provide an elastic force for forcing the dial (14) to abut on structural body (26). As shown in FIGS. 2, 3, and 4, each dial (14) is a composite body consisting of rotation wheel (38) and toothed wheel (40) which are inseparable from each other. The rotation wheel (38) has a diameter larger than that of the wheel (40). Each rotation wheel is provided with a number of numerals on the upper surface thereof and is provided with many fine stripes on the circumference thereof providing the necessary friction for the dialing operation by a finger. Each toothed wheel (40) has teeth (42) and grooves (33), wherein each tooth corresponds to a numeral on the upper surface of the rotation wheel (38). Therefore, the number of the teeth in the wheel (40) is equal to that of the numerals on the upper surface of the rotation wheel (e.g, there are 10 teeth and 10 numerals in each dial as shown in FIG. 9). The toothed wheel (40) is provided on its bottom with corresponding dents (44) which can be engaged with a plurality of raised points (45) spaced apart around axle (36) on structural body (26) to achieve the indexing effect for each dial. In FIGS. 6 and 7 is shown a driven wheel (16) which is a toothed wheel with an inseparable disc on each side thereof. One of the discs is hub disc (48), and the other is wheel disc (50). The recesses (52) and (54) of the two respective discs are in alignment with each other. Toothed wheel (46) and toothed wheel (40) of each dial have the same type and number of teeth. Hub disc (48) is freely rotatably mounted in aperture (56) of positioning sheet (20). Wheel disc (50) is mounted in aperture (58). Positioning sheet (20) is mounted on step (60) of structural body (26) so that it can slide between two walls (62) and can be restrained by stops (64). When positioning sheet (20) abuts stops (64), each driven wheel (16) and dial (14) are in mesh with each other. When a dial (14) is dialed for rotation, the driven wheel (16) will rotate simultaneously in an opposite direction. Each aperture (56) is provided with a groove (66) on the circumference thereof. The inner end of each groove (66) is provided with a stop (68). An elongate aperture (70) is formed in the middle portion of positioning sheet (20). A tongue (72) is provided on the circumference of aperture (70). A rivet hole (74) is formed in sliding sheet (18) so that sliding sheet (18) and push button (12) can be riveted together by rivet (13) and thereby can move together. Sliding sheet (18) is provided on each side edge thereof with an inserting tab (76) which is mounted in a corresponding groove (66) of positioning sheet (20) and can be either inserted into the corresponding recess (52) or abutted against the corresponding stop (68). Sliding block (22) is provided at one end with a tongue (78) for retaining the article to be locked. Tab (76A) of sliding sheet (18) is put on the notch (80A) of sliding block (22) thereby they can move together. A hole (80) is formed in the other end of sliding block for receiving one end of spring (30). Sliding block (22) is provided on the bottom surface thereof with a sliding key (82) which can slide along a straight line in groove (84). One end of spring (30) is inserted into hole (80), and the other end of spring (30) is mounted around tongue (72). In this state, surface (86) abuts end (88) of groove (84), and positioning sheet (20) abuts stop (64). Back cover (28) is provided with a plurality of nails (90) which can be inserted into and fixed to the briefcase. A plurality of rivet holes (92) is formed in back cover (28) so that it can be riveted to structural body (26). The body is also engaged on one side thereof with a sheet spring for ejecting the locked article. When the article to be locked is inserted into the lock, sheet spring (24) is deflected. When the dials are on-combination and the push button is pushed downwards, tongue (78) is withdrawn from the locked article, and then the article is ejected out by the elastic force of sheet spring (24).

The lock is assembled by: first riveting back cover (28) and structural body (26), then disposing the driven wheels (16), dials (14), positioning sheet (20), sliding block (22), spring (30), sheet spring (24), and sliding sheet (18) in body (26), covering them with case body (10), bending inwardly the retaining tab (11), inserting the rivet of push button (12) through aperture (101) and aperture (74) of sliding sheet (18), and finally riveting push button (12) and sliding sheet (22) together.

Figure 1:
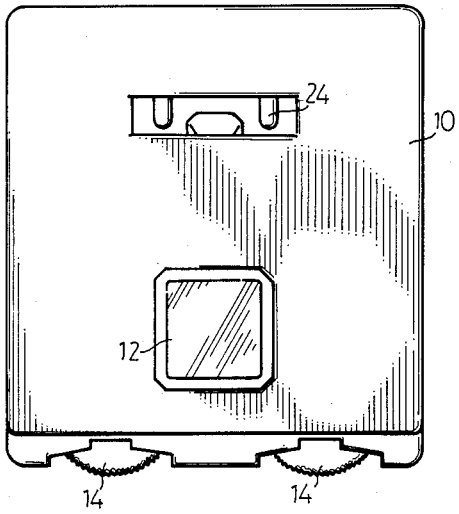
FIG. 1 is a front outside view of the combination lock in accordance with the invention.
Figure 5:
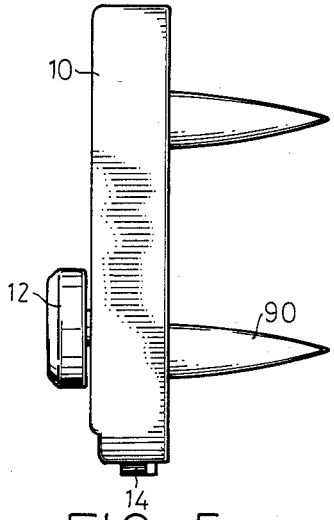
FIG. 5 is a side outside view of the combination lock.
Figure 10:
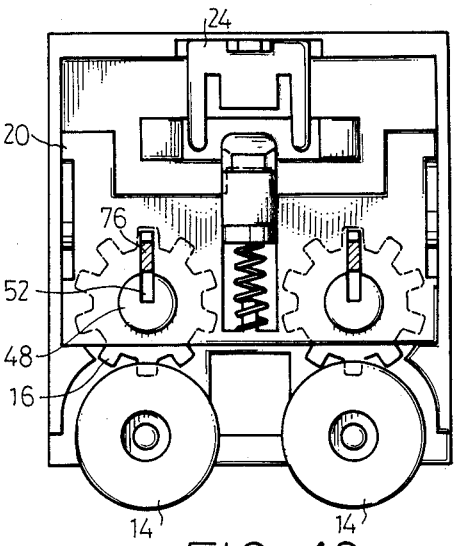
FIG. 10 is a schematic drawing illustrating the combination lock in its on-combination and openable state.
Figure 11:
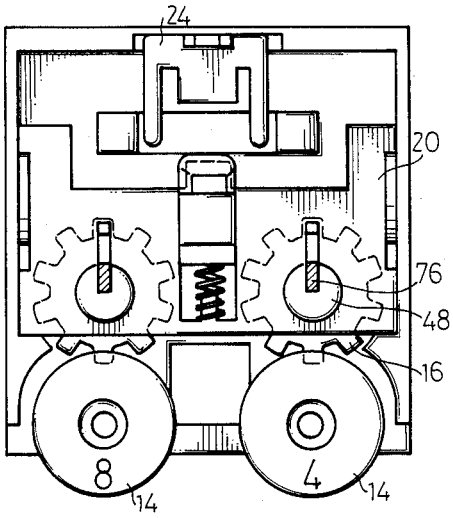
FIG. 11 is a schematic drawing illustrating the combination lock in its on-combination state wherein the push button has been pushed downwards.
Figure 12:
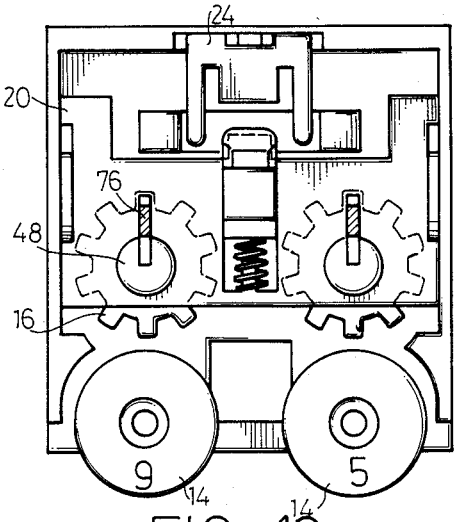
FIG. 12 is a schematic drawing illustrating the combination lock in its on-combination state wherein the push button has been pushed upwards.

The operation of an embodiment of the invention is described with reference to FIGS. 9 to 12 which are views taken from the front of the combination lock as shown in FIG. 1. However, in FIGS. 9 to 12, case body (10), push button (12), and sliding sheet (18) are assumed to be transparent for clarity. FIG. 9 shows the locked state in which any recess (52) of a driven wheel (16) is not in alignment with the corresponding inserting tab (76), and therefore sliding sheet (18) cannot be moved. FIG. 10 shows that when the dials are rotated to 8 and 4 respectively (i.e. they are on-combination), each recess (52) is in alignment with the corresponding inserting tab (76) so that push button (12) can be pushed downwards. As illustrated in FIG. 11, when the push button has been pushed downwards, each recess (54) of the corresponding rotation disc (50) is also in alignment with the corresponding projection on the circumference of the corresponding aperture (58) so that sliding block (22) is concomitantly moved downwards, and spring (30) is compressed. To change combination from the on-combination state, push the push button upwards (i.e. in a direction opposite to that for opening the lock). In this operation, each inserting tab (76) abuts the corresponding stop (68) so that positioning sheet (20) will be concomitantly moved upwards and be moved away from stops (64). Thereby each driven wheel (16) is disengaged from the corresponding dial (14) so that each dial (14) can be dialed to select a new combination. If the new combination is selected as "5-9" as shown in FIG. 12, and the push button is released, then the lock can only be opened when the dials are on this new combintion. Moreover, back cover (28) is provided therein with two observation apertures (96) at the locations corresponding to every aperture (58) so that the recess (54) of each driven wheel (16) can be seen from the corresponding aperture (96). Thereby, the combination of the lock can be known readily during fixing of the lock to the briefcase.

I claim:

1. A combination lock for a briefcase, comprising a case body, a push button, a plurality of combination dials, a plurality of driven wheels, a sliding sheet, a positioning sheet, a sliding block, a structural body, a back cover and a plurality of springs; when the dials are on-combination, the push button can be pushed in a direction for opening the lock and can be pushed in an opposite direction for changing combination; the combination lock is characterized in that each combination dial is a composite body consisting of a rotation wheel and a toothed wheel, wherein the diameter of the toothed wheel is not larger than that of the rotation wheel, and the dial being provided on its bottom surface with a plurality of dents; each of the driven wheels being in the form of a disc on one side of which is provided a hub disc, and on the other side of which is provided a wheel disc, wherein both of the hub disc and wheel disc are provided with a recess at the same location; each driven wheel being drivable by one of the dials when in mesh with that dial; a plurality of axles provided on the structural body, each dial being mounted on one of the axles; a plurality of raised points provided around each axle on the surface of the structural body for engagedly cooperating with the dents on the bottom surface of each dial; a spring mounted on each axle for forcing each dial to abut against the structural body; the sliding sheet being provided at its two opposite sides with two inserting tabs respectively; the push button can be pushed downwards when each inserting tab is in alignment with the corresponding recess of the hub disc; each wheel disc of the driven wheel being mounted in a corresponding circular aperture in the structural body; when each recess of the wheel disc is in alignment with the corresponding projection provided on the circumference of the circular aperture, the push button can be pushed in the opposite direction so that each driven wheel is disengaged from the corresponding dial to achieve a combination-changeable state.

* * * * *